United States Patent [19]

Inman

[11] 4,285,287

[45] Aug. 25, 1981

[54] APPARATUS FOR SHIFTING TUFTING MACHINE NEEDLE BAR

[75] Inventor: Billy E. Inman, Signal Mtn., Tenn.

[73] Assignee: Spencer Wright Industries, Inc., Chattanooga, Tenn.

[21] Appl. No.: 186,115

[22] Filed: Sep. 11, 1980

[51] Int. Cl.[3] ..... D05C 15/30

[52] U.S. Cl. ..... 112/79 R

[58] Field of Search ..... 112/79 R, 79 A, 78, 112/98

[56] References Cited

U.S. PATENT DOCUMENTS

| | | | |
|---|---|---|---|
| 3,301,205 | 1/1967 | Card | 112/79 R |
| 3,393,654 | 7/1968 | Barnes | 112/79 R |
| 3,964,407 | 6/1976 | Ingram et al. | 112/79 R |

*Primary Examiner*—H. Hampton Hunter

*Attorney, Agent, or Firm*—Alan Ruderman

[57] ABSTRACT

A tufting machine having a needle bar shifter apparatus including a follower member operatively connected to the needle bar and positioned within a guideway tiltable about both a lower pivot and an upper pivot. External force applied by positioner devices is selectively applied to pivot the top of the guideway about the lower pivot while the needle bar and follower member are in a lower position with a follower substantially aligned axially with the lower pivot, and to pivot the guideway about the upper pivot when the needle bar and follower member are in an upper position substantially aligned with the upper pivot point. The guideway is pivotably connected to control rods driven by the positioner devices. The momentum of the reciprocating needle bar provides a substantial amount of the force required for a lateral shift, and only small external force need be applied to the control rods.

6 Claims, 7 Drawing Figures

APPARATUS FOR SHIFTING TUFTING MACHINE NEEDLE BAR

BACKGROUND OF THE INVENTION

This invention relates to tufting machines and more particularly to a new and improved needle bar shifting apparatus for shifting the individual yarn ends transversely between the longitudinal rows of pile formed by the tufting machine.

The art of tufting incorporates a plurality of yarn carrying spaced needles extending transversely across the machine and reciprocated cyclically to penetrate and insert pile into a backing fabric fed longitudinally beneath the needles. During each penetration of the backing fabric a row of pile is produced transversely across the backing. Successive penetrations result in a longitudinal row of pile produced by each needle. This basic method of tufting limits the aesthetic appearance of tufted carpet so produced.

Both the noticeable alignment of the longitudinal rows or "corn cob effect" and the visible optical streaking resulting from variations in coloration of the yarn that detracts from the appearance of a carpet can be effectively overcome by shifting the needles relatively to the backing fabric. Stepping of the needle bar laterally so that each needle stitches in a zig zag manner is the most popular of the methods of obtaining the relative shifting between the needles and the backing.

Various devices have been proposed and are in use for controllably applying a step-wise force to the needle bar of the tufting machine in accordance with a pattern. For example, the primary means for supplying this jogging has been a pattern cam driven in timed relationship to the reciprocation of the needle bar and acting upon a cam follower mechanism coupled to the needle bar. Exemplary of this prior art device are U.S. Pat. Nos. 3,026,830 and 3,934,524. Because of the generally limited longitudinal pattern repeat of a cam, the cam providing a longitudinal repeat every revolution thereof, other prior art needle bar shifters have been developed. The known systems are disclosed in U.S. Pat. Nos. 3,964,408 and 3,972,295, which utilize pawl and ratchet devices; U.S. Pat. No. 4,010,700 which uses an indexing device; and U.S. Pat. No. 4,173,192 which uses a hydraulic actuator.

In each of the known prior art needle bar shifters a member connected to the needle bar is transversely or laterally moved by the shifter mechanism while the needle bar is in the upper portion of its vertically reciprocating travel and the needles are above the backing fabric. In a fall sized tufting machine a needle bar weighs in order of 100 pounds. Thus, during the needle bar reciprocation a substantial force must be exerted on the moving needle bar to step it laterally within a relatively short period of time. Due to this inertia difficulty tufting machines operating with a needle bar shifter are run at speeds substantially lower than that which they are otherwise capable. This reduction in speed is generally in the order of approximately one-half the speed of machines which run without shifters and the yardage output is decreased proportionately.

SUMMARY OF THE INVENTION

The present invention provides a novel construction for shifting or jogging a needle bar in which a substantial amount of the lateral shifting force is supplied by the inertia of the reciprocating needle bar. The needle bar, which is slideable within a reciprocating support, has a follower member secured thereto, positioned within a guideway tiltable about both a lower pivot and an upper pivot point through substantially the same angle linearly equivalent to a lateral step of the needle bar. External force is selectively applied to pivot the guideway about the lower pivot while the needle bar and follower member are in a lower position, and about the upper pivot when the needle bar and follower member are in an upper position. Since the needle bar is constrained to a path determined by the disposition of the guideway, the needle bar makes a controlled step angularly when an external force is applied to effect a lateral shift. The external force required to move the top of the guideway when the follower is in the bottom thereof and to move the bottom of the guideway when the follower is at the top thereof, is substantially less than the lateral force which would be required to laterally shift a conventionally moving needle bar since the applied force is not acting on the total load of the needle bar. Consequently, the time required to effect a lateral shift is substantially shorter than that required by the prior art constructions and the tufting machine can be operated at higher speeds than current tufting machines having shiftable needle bars.

Consequently, it is a primary object of the present invention to provide a needle bar shifter apparatus for a tufting machine having a needle bar positioner, the apparatus being such that shifting of the needle bar can be effected in a short time, thus permitting the machine to be operated at higher speeds than heretofor possible.

It is another object of the present invention to provide a needle bar shifter apparatus that applies a component of the reciprocating force of the needle bar to aid in forcing the needle bar laterally during a controlled jog.

It is a further object of the present invention to provide a needle bar shifter construction having guide means for constraining the reciprocating path of the needle bar, the disposition of the guide means being directed by a needle bar positioner means.

It is a yet further object of the present invention to provide a needle bar shifter apparatus for a tufting machine including guide means selectively controllable by needle bar positioner means for directing the movement of the needle bar, the guide means being pivotably carried by vertically spaced control members sequentially jogged by the positioner apparatus to step the top of the guide means laterally relative to the lower control member and then to step the bottom of the guide means laterally relative to the upper control member.

It is a yet still further object of the present invention to provide a needle bar shifter apparatus having a controllably moveable guide member having a guideway whose path the needle bar is constrained to follow and positioner means for laterally moving the top of the guideway when the needle bar is constrained in the bottom of the guideway and for moving the bottom of the guideway an equal lateral amount when the needle bar is constrained in the top of the guideway thereby minimizing the amount of external force required to laterally move the needle bar.

BRIEF DESCRIPTION OF THE DRAWINGS

Other objects and advantages of the invention will best be understood upon reading the following detailed description of the invention with the accompanying drawings, in which.

DETAILED DESCRIPTION OF THE PREFERRED EMBODIMENT

Figure 1:
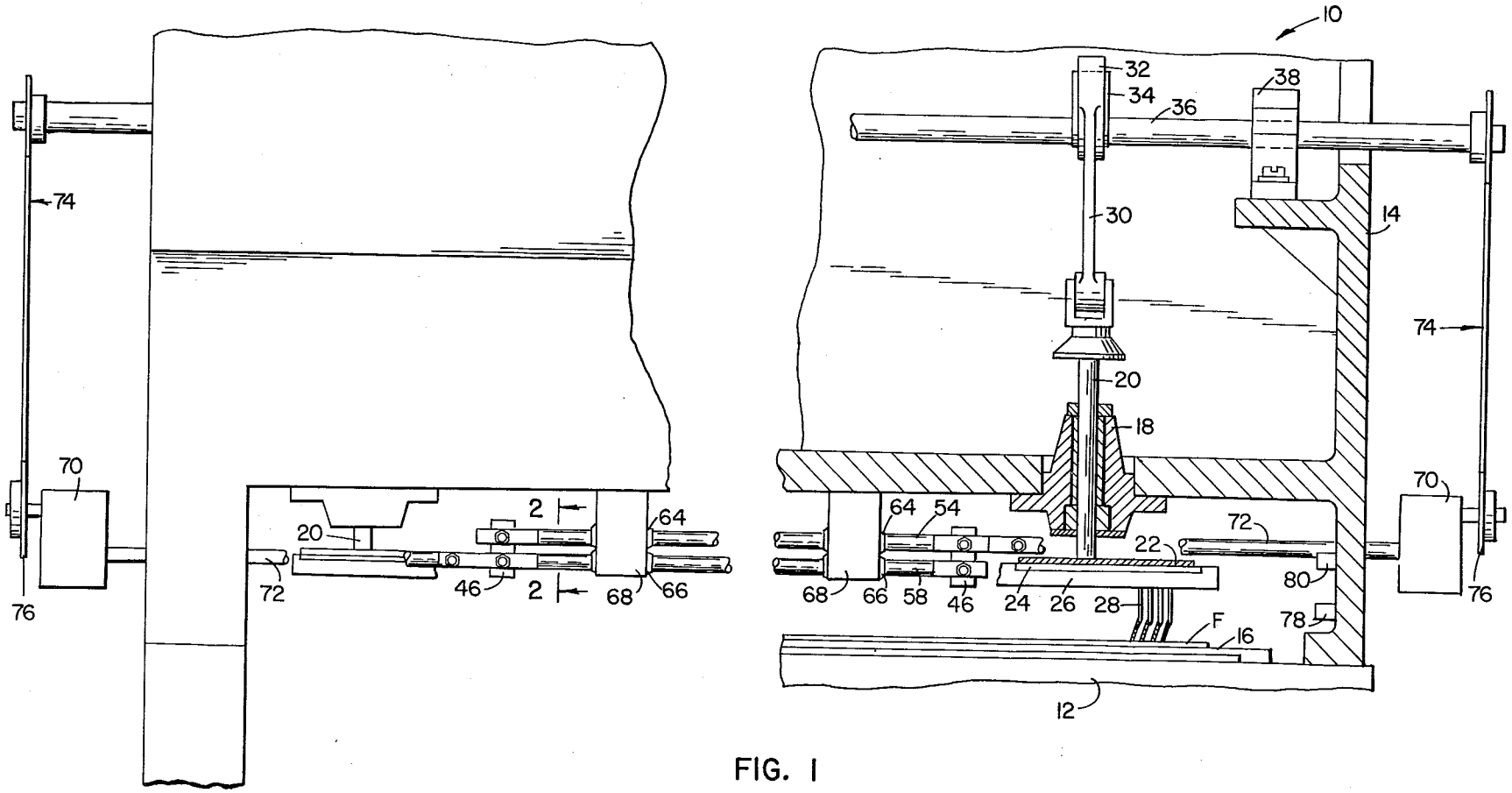
FIG. 1 is a fragmentary sectional view of a tufting machine incorporating a needle bar shifter apparatus constructed in accordance with the principles of the present invention.

Referring now to the drawings there is illustrated a portion of a tufting machine 10 having a frame comprising a bed 12 and a head 14 disposed above the base. The bed 12 includes a needle plate 16 over which a backing fabric F may be fed in a conventional manner.

Mounted in the head 14 for vertical reciprocation within laterally spaced bushing assemblies 18 are two of a number of push rods 20 to the lower ends of which a needle bar support foot 22 is carried. The support feet 22 have a substantially inverted U- shaped configuration in end elevation best illustrated in FIG. 3 including undercut flanges 24 at the extremeties to form a slideway. A needle bar 26 substantially conforming in shape to the interior of the support feet is positioned within the slide- way on bearings for slideable movement relatively thereto. For a more detailed description of the construction of the needle bar reference is made to Bryant et al U.S. Pat. No. 3,026,830. The needle bar 26 may thus reciprocate with the push rods 22 and slide laterally relative thereto in a controlled path as hereinafter described in the direction transverse to the feeding of the backing fabric. The needle bar 26 in turn carries a plurality of needles 28 that are adapted to penetrate the fabric of the needle plate 16 upon reciprocation of the needle bar 26 to project loops of yarn therethrough. Endwise reciprocation is imparted to the push rods 20 and thus the support feet 22 and the needle bar 26 and needles 28 by a link 30 which is pivotably connected at its lower end to the push rods 20 and which has at its upper end an eccentric strap 32 journalled on an eccentric 34 secured to a driven rotary main shaft 36 that is journalled longitudinally in bearing blocks 38 mounted in the head. Although not illustrated, a plurality of hooks conventionally are mounted in the bed 12 for oscillation beneath the needle plate 16 for cooperation individually with one of the needles to seize a loop of yarn presented by the needle and to hold the same as the needle is withdrawn. A knife conventionally may coact with each looper to cut the loops seized for forming cut pile fabric.

Figure 3:
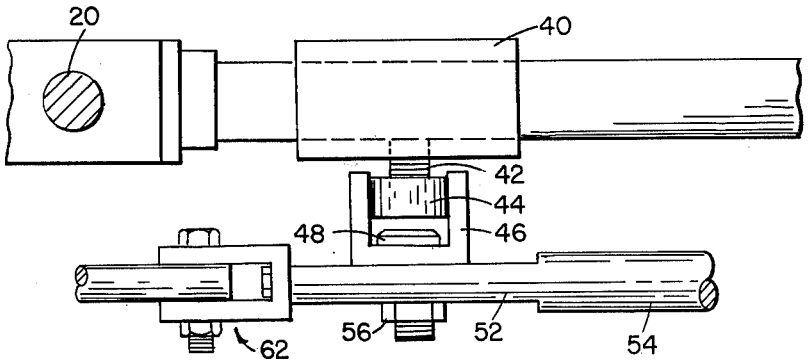
FIG. 3 is a horizontal sectional view of a portion of the needle bar taken substantially along line 3—3 of FIG. 2.
Figure 2:
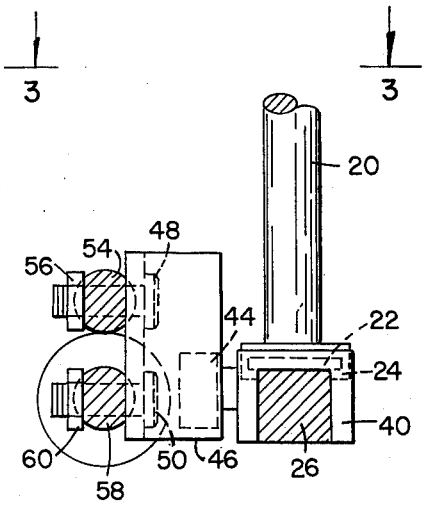
FIG. 2 is an enlarged vertical sectional view taken substantially along line 2—2 of FIG. 1.
Figure 4:
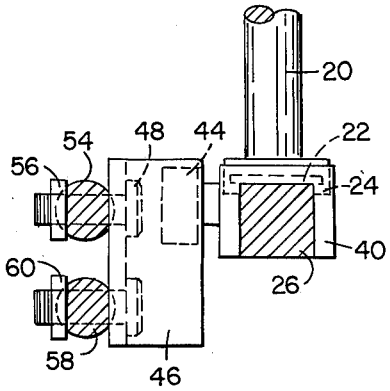
FIG. 4 is a view similar to FIG. 2, but with the needle bar in an elevated position relative thereto.

The needle bar shifter apparatus of the present invention effectively utilizes the momentum or inertia of the reciprocating needle bar to supply a portion of the force to move the needle bar laterally transverse to the feeding direction of the backing fabric. To this end the needle bar includes at least one and preferably a number of spaced bracket members 40 clamped thereto intermediate a pair of the support feet 22. Each bracket 40, as best illustrated in FIGS. 2 and 3, straddles the needle bar and threadedly carries a stud shaft 42 extending therefrom substantially normal to the vertical plane of reciprocation of the needle bar. At its other end a follower or roller member 44 journalled on a bearing is carried by the stud shaft and is positioned within a guide member 46 substantially U-shaped in cross section and normally vertically disposed with the legs of the guide member parallel to the push rods 20. The spacing between the legs of the guide member define a channel shaped guideway such that the follower or roller is constrained to movement therebetween with a sliding or rolling action dependent upon the angular disposition of the guide member and thus the guideway.

The guide member 46 is elongated a distance at least substantially equal to the stroke of the needle bar so that the follower 44 remains constrained within the guideway during the reciprocation cycle of the needle bar. The rear wall of the guide member which interconnects the legs defining the guideway includes a pair of vertically spaced headed studs 48, 50 extending therethrough. The upper stud 48 journally extends through a flattened reduced portion of an upper control rod 54 and has a securing nut or the like 56 threaded onto its end. Similarly, the lower stud 50 is journally attached to a lower control rod 58 and held in place by a nut 60. Each control rod 54, 58, which may comprise a series of rods coupled together as at 62, extends laterally of the tufting machine transverse to the direction of feeding of the fabric and is journally supported in respective linear bearings 64, 66 carried by spaced bearing block 68 depending from the head 14 of the tufting machine.

It should be understood that when the needle bar is positioned in a lower position as illustrated in FIG. 2 with the axis of the follower 44 substantially aligned with the axis of the stud 50, a small linear force applied to the upper control rod 54 will effect a pivoting of each guide member 46 about the lower stud 50 thereby moving the top of the guide member laterally. Similarly, when the needle bar is in an upper position as illustrated in FIG. 3 with the axis of the follower 44 in substantial alignment with the axis of the upper stud 48, the guide member 46 may be pivoted about the upper stud 48 by a small force linearly applied to the lower control rod 58, thereby moving the bottom of the guide member laterally. By sequencing the timing of the forces applied to the control rods such that the force applied to the upper rod is applied when the needles are just exiting from the needle plate, and the force applied to the lower rod is applied when the needle bar is at approximately top dead center, the top and then the bottom of the guide member can step laterally during the portion of the cycle the needles are free of the needle plate fingers. Thus, the top of the guide member can step one gauge length when the follower 44 is aligned with the axis of the stud 50 by pivoting about the lower axis and then the bottom of the guide member can step one gauge length while the follower 44 is aligned with the axis of the upper stud 48 by pivoting about the upper axis.

Figure 5:
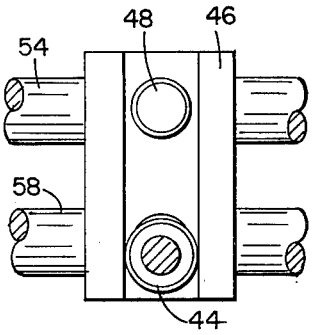
FIG. 5 is a diagrammatic front elevational view of a guide member of the present invention illustrating its disposition and operation prior to a lateral shift of the needle bar.
Figure 6:
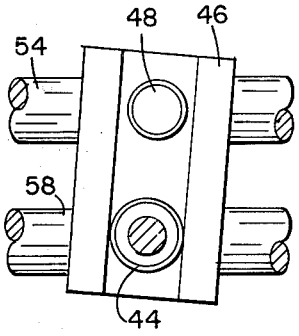
FIG. 6 is a view similar to FIG. 5, but with the upper portion of the guide member shifted pivotably during the first phase of a lateral shift.
Figure 7:
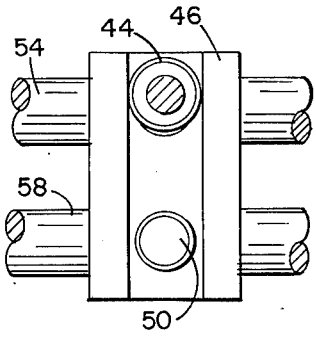
FIG. 7 is a view similar to FIG. 6, but at the completion of the second phase of a lateral shift after the lower portion of the guide member has shifted pivotably.

The operation can be further understood with reference to FIGS. 5 through 7 illustrating diagrammatically the sequence of steps when a lateral shift of the needle bar is directed. FIG. 5 illustrates the normal position of the guide member 46 during the loop forming and seizing portion of the tufting cycle, and depicts the position of the follower 44 as the needle bar reciprocates upwardly just prior to the needles exiting from the needle plate. In FIG. 6 the center of the follower 44 is at the axis of the lower pivot stud 50, which ideally is the location at which the upper portion of the guide member should be jogged since the minimum force is then required. The control rod 54 thus pivots the top of the guide member by a distance substantially equal to one gauge space, i.e. the distance between adjacent rows of loopers or needles. As the needle bar continues its upward path now angularly disposed due to the constraint of the guideway and reaches the position where the center of the follower is aligned with the axis of the upper pivot stud 48, the lower control rod 58 is jogged laterally the same one gauge space to the position illustrated in FIG. 7. The guide member 46 and thus the needle bar (and of course the needles) are thus one gauge space from the initial position of FIG. 5. An oppositely directed shift takes place in a similar manner.

In order to shift or step the control rods 54 and 58 with controlled lateral movement, positioner means having a controlled output is provided for driving each of the control rods. The positioners may be a pattern cam such as illustrated in U.S. Pat. No. 3,026,830; a programmable mechanical device such as disclosed in U.S. Pat. Nos. 3,964,408 and 4,010,700; or a hydraulic device similar to that disclosed in U.S. Pat. No. 4,173,192; or a stepper motor which, as well known in the art, receives and counts a controlled number of pulses and rotates through an angular increment related to the number of pulses received, such rotation can be utilized to drive a ball screw which converts the rotation of the stepper motor to a linear output for driving the control rods. Because of the relatively small force required for providing a shift of the needle bar the stepper motor/ball screw is an attractive alternative to the prior art positioners used in conjunction with tufting machines. In regard to the present invention the specific positioning devices 70 used to provide the patterned step shift is not critical as any of the known devices referred to above can be used. Each such device includes an output member 72 controlled in accordance with the pattern and driven in timed relationship to the tufting machine. For example, and for purposes of disclosure a chain and sprocket means 74 may drive an input member 76 of one of the known positioners from the tufting machine main shaft 36. The output member 72 of each device 70 is connected to one of the control rods 54 and 58. Conventional position sensors 78 and 80, which may be of the photo-electric type, may be mounted on the head 14 of the tufting machine, the sensor 78 providing a signal to the positioning device 70 when the needle bar has reached a position where the needles 28 are free of the needle plate to enable the positioner so that its output member can jog the upper control rod 54, while the upper sensor 80 provides a similar signal for a similar purpose to the other positioner when the needle bar is at approximately top dead center position to jog the lower control rod 58.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a tufting machine having a reciprocating needle bar carrying a plurality of needles spaced transversely across the machine and adapted to penetrate a base material moving longitudinally across a support plate thereof to insert a plurality of stitches upon each penetration of the base material, and mounting means for mounting said needle bar for transverse movement relatively to the base material, the improvement comprising, first and second control members vertically spaced one from the other, journal means for mounting both said control members for transverse movement relatively to said base material, a guide member including a guideway, means for pivotably mounting said guide member to each of said control members, a follower disposed within said guideway, means connecting said follower to said needle bar, whereby the path of movement of the needle bar is determined by the disposition of the guideway, and positioning means for selectively providing a controlled transverse step shift while the needles are above the support plate to the upper of said control members and then to the lower control member thereby to shift the needle bar transversely.

2. In a tufting machine as recited in claim 1, wherein said control members comprise parallel rods.

3. In a tufting machine as recited in claim 1, wherein said guideway comprises a channel formed in said guide member.

4. In a tufting machine as recited in claim 3, wherein said follower comprises a roller, and said means connecting said follower to said needle bar includes means for journally supporting said roller for rolling within said channel.

5. In a tufting machine as recited in claim 1, wherein said positioning means comprises a first position shifter for driving the upper control member and a second position shifter for driving the lower control member.

6. In a tufting machine as recited in claim 5, including means for sensing the position of the needle bar when the needles first exit from the support plate and for activating said first position shifter, and means for sensing the position of the needle bar when the needle bar is adjacent the position furthest from the support plate and for activating said second position shifter.

* * * * *